United States Patent [19]

Lin

[11] Patent Number: 4,966,289

[45] Date of Patent: Oct. 30, 1990

[54] SERIES OF PERIPHERAL APPARATUSES FOR RAIL TYPE OF DRAFTING TABLE

[76] Inventor: Long-Cing Lin, 2th Fl., 39, Alley 9, Lane 385, Ching Ping Rd., Chung Ho City, Taipei Hsien, Taiwan

[21] Appl. No.: 276,942

[22] Filed: Nov. 28, 1988

[51] Int. Cl.[5] ..... A47F 5/00

[52] U.S. Cl. ..... 211/69.5; 211/13

[58] Field of Search ..... 211/13, 69.1, 60.1, 211/69.5; 108/28, 32

[56] References Cited

U.S. PATENT DOCUMENTS

| | | | |
|---|---|---|---|
| 2,957,270 | 10/1960 | Kennamer | 211/69.5 |
| 3,476,257 | 11/1969 | O'Connell | 211/69.5 X |
| 3,476,259 | 11/1969 | Price | 211/13 X |
| 3,643,605 | 2/1972 | Miller | 211/69.1 X |
| 4,406,368 | 9/1983 | Hermes | 211/69.1 X |
| 4,826,338 | 5/1989 | Kilpatrick | 211/69.1 X |

*Primary Examiner*—Robert W. Gibson, Jr.
*Attorney, Agent, or Firm*—Veracity Fokaard

[57] ABSTRACT

An apparatus attachable to a drafting table to store drafting equipment for ready access by a person while using the table. The apparatus preferably includes a rail extending above the drafting surface between the front and rear edges of the table; the rail can be moved transversely between the two side edges of the table. A flat base is slidably suspended from the rail for two-way adjustment across the space between the edges of the table. The base supports a storage tray above the table surface; a second instrument tray is swingably attached to the front edge of the base. This last tray can assume an upright position when the drafting table is tilted to selected inclined positions. The tray support system makes the trays steadily available, while permitting the trays to be readily shifted from areas of the table being used for drafting purposes.

6 Claims, 10 Drawing Sheets

SERIES OF PERIPHERAL APPARATUSES FOR RAIL TYPE OF DRAFTING TABLE

BACKGROUND OF THE INVENTION

Generally, the drafting tables may be classified into two categories, i.e., the suspension arm type and the rail type; however, the former type has been out of date, and the rail type is the only popular one at the present time. A draftsman or a designing person before making a drawing has to refer to a lot of reference materials, such as a blue print, a design reference or reference tables, etc. On the old type of such drafting table, there is no room to place the aforesaid reference materials, and therefore the draftsman always experiences some inconvenience while working. Usually, the old rail type of drafting table is usually provided with a rack under the drafting table for storing and placing various instruments or reference materials. That rack would cause more or less inconveniences to the draftsman because he (or she) must bend the body or creep under the table to pick up an instrument, in that case, the draftsman's thinking or imagination is susceptible to being interrupted. In the old type of drafting table, the lower side thereof is attached with a small channel structure for placing small instruments, such as rubber erasers, and compasses. Such a small channel has insufficient room for placing a drawing template (or templates); therefore, an additional cabinet has to be added to take more space. Moreover, when using the technical drawing pens, each of them must always be protected with a lid to prevent it from being dried, and it is deemed a cumbersome work for the draftsman. For instance, the two legs of the compasses have to be recovered together after each measuring, and to be opened again for next measuring. Further, the aforesaid small channel is unable to accommodate instruments in a neat manner, and is susceptible to retaining dirt therein. All the aforesaid drawbacks of the old type of drafting table would annoy the draftsman.

In view of the aforesaid drawbacks of the old type of drafting table, the inventor has developed this invention, which includes a vertical rail on the right side of the conventional rail type of drafting table. The new vertical rail carries a storage tray, auxiliary instrument tray, and a draft panel; all the aforesaid peripheral apparatuses would facilitate the drawing operation of a draftsman so as to increase his (or her) working efficiency.

SUMMARY OF THE INVENTION

This invention provides a series of peripheral apparatuses for rail type of drafting table. According to the present invention, the right side rail of the drafting table is provided with a vertically moved rail channel and a storage tray, and both of them are fastened together. On the right side of the rail channel, there is installed a connecting plate, on which a draft panel is inserted. At the lower end of the rail channel, there is a movable auxiliary instrument tray, on which some stationery items such as a rule, technical drawing pens compasses, pencils, drawing templates and a brush are placed. The storage tray is used for placing a vernier caliper, an electronic calculator, and a chit book. The draft panel is used for attaching a draft, and the draft panel can also be moved at any angle desired so as to let draftsman see a draft at a comfortable position.

Briefly, the present invention is a series of peripheral apparatuses to be mounted on a rail type of drafting table for storing and placing drafting instruments so as to let a draftsman conveniently pick up drafting instruments to facilitate the drafting operation.

DETAILED DESCRIPTION

Figure 1:
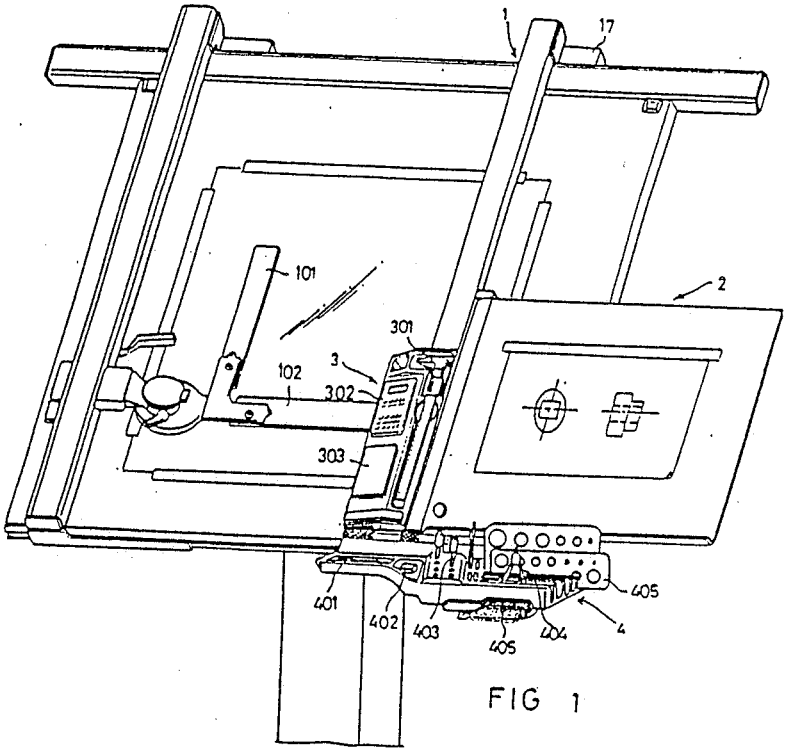
FIG. 1 is a perspective view of an embodiment according to the present invention.
Figure 2A:
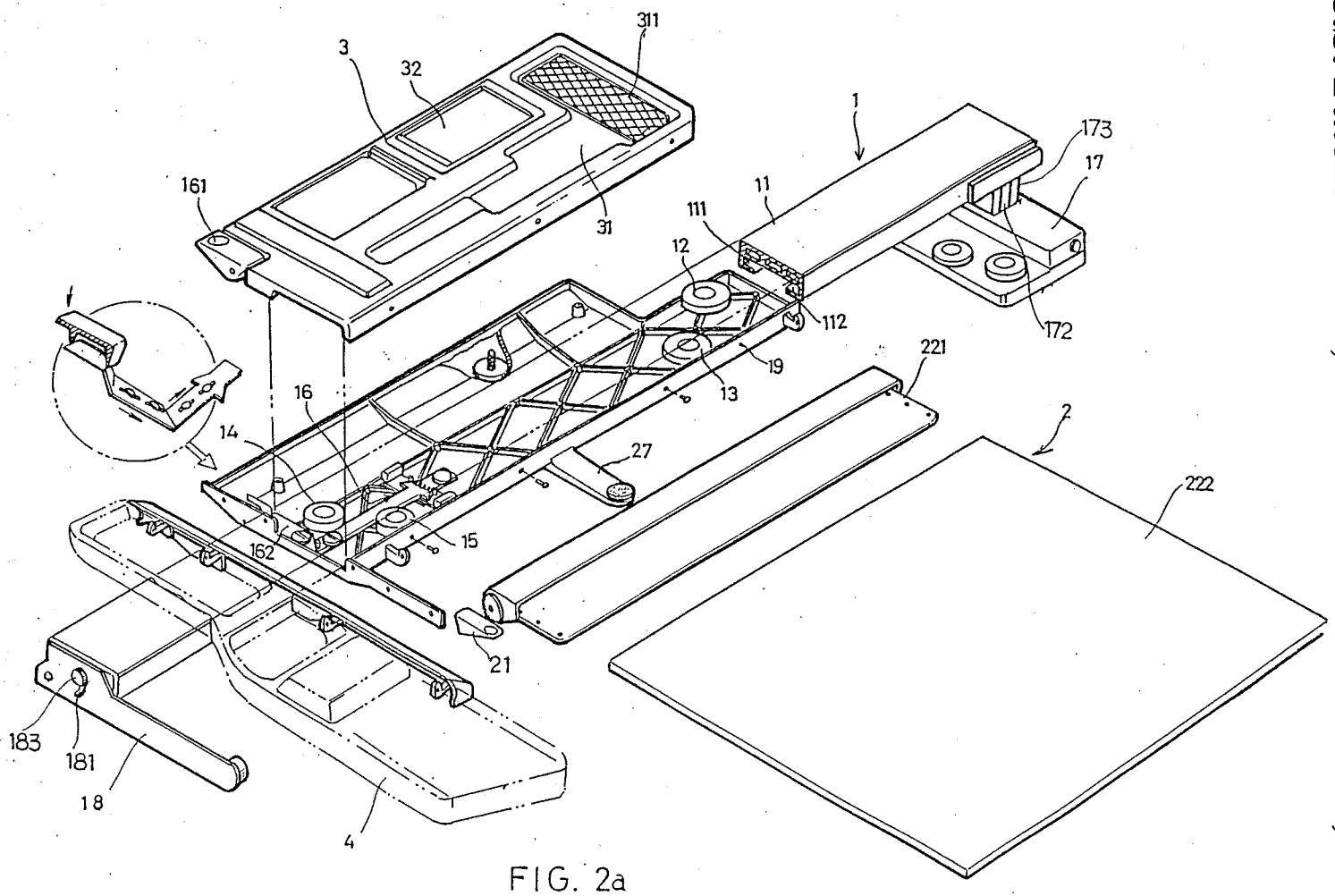
FIG. 2*a* is a disassembled view, including a sliding rail, a draft panel, a storage tray and an auxiliary instrument tray according to the present invention.
Figure 3:
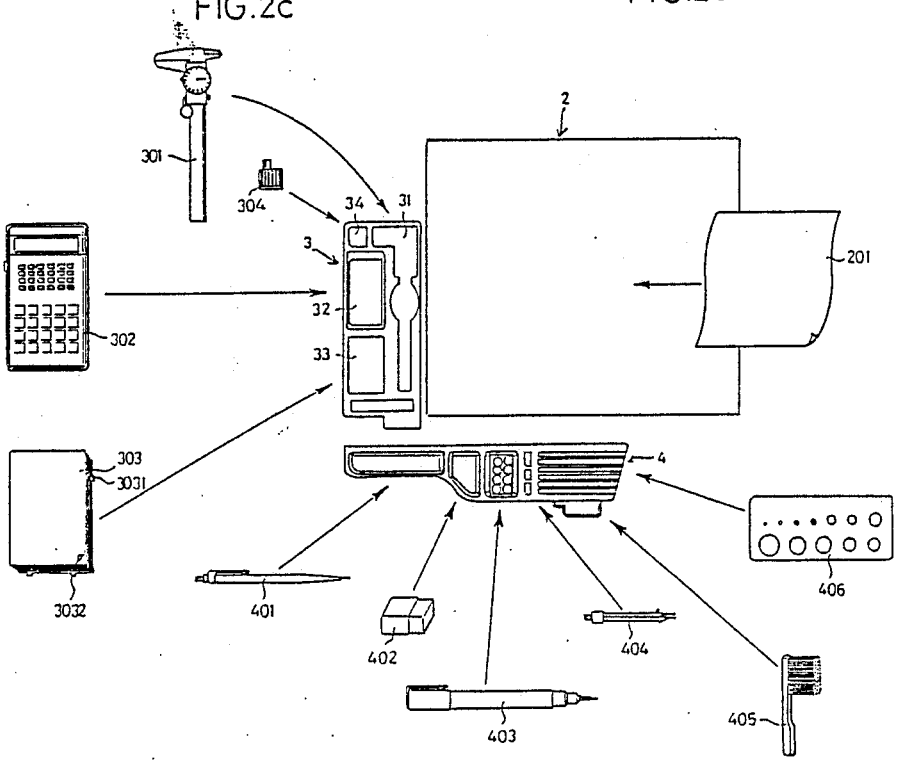
FIG. 3 illustrates the operation view of the present invention.
Figure 7B:
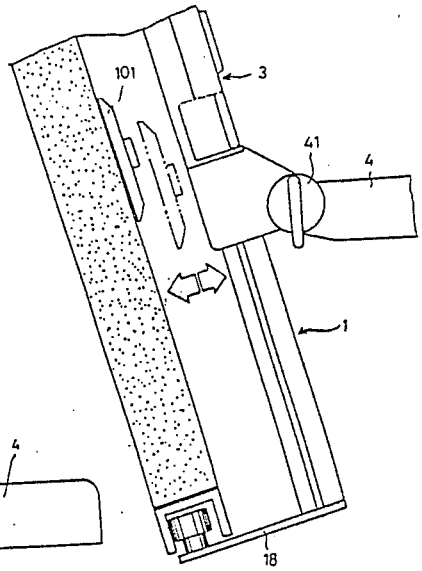
FIG. 7*b* illustrates the space between the sliding rail and the drafting board surface, and that space would not affect the movement of the horizontal rule.
Figure 8A:
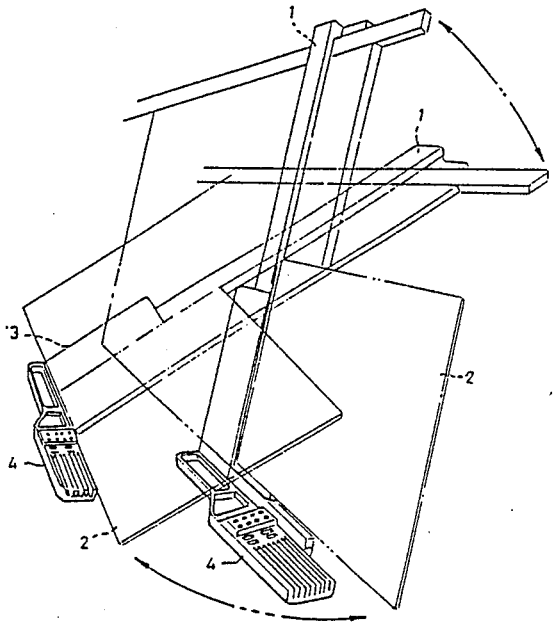
FIG. 8*a* illustrates the auxiliary instrument tray always maintaining at a horizontal position no matter the drafting board being set at any slantning angle.
Figure 11A:
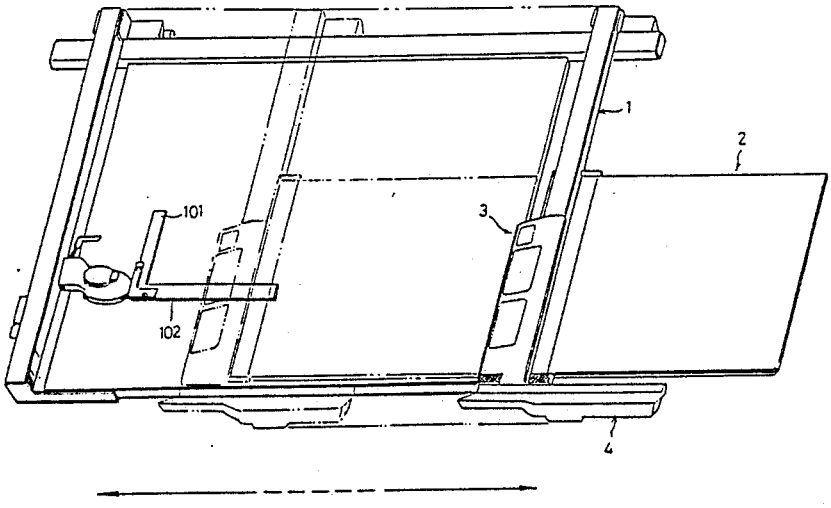
FIG. 11*a* illustrates the peripheral apparatuses of the present imvention, being moved laterally.

The structure and operation of the present invention are further described in detail as follows: Referring to FIG. 1, 2*a* and 3, there show the assemblies and function of the present invention, in which the upper and lower of the sliding rail 1 are attached to a rear guide 17 and an auxiliary front roller frame 18 respectively. The roller on frame 18 runs inside the rail channel of the rail type of drafting board for smooth lateral movement as shown in FIG. 11*a*. There is a suitable space between the sliding rail 1 and the drafting board and therefore the horizontal scale 101 and the vertical scale 102 can be lifted up and moved freely without hindreing drafting operation. (as shown in FIG. 7*b*). The drafting board is a conventional board capable of tilting adjustments; FIG. 8*a* shows two tilted positions that the board can take. As shown in FIG. 8*a*, rail 1 extends between the front and rear edges of the drafting board for transverse adjusting movements between the two side edgesd of the drafting board. Rail 1 movably supports a storage tray 3, an instrument tray 4, and an auxiliary drafting panel 2.

Figure 4:
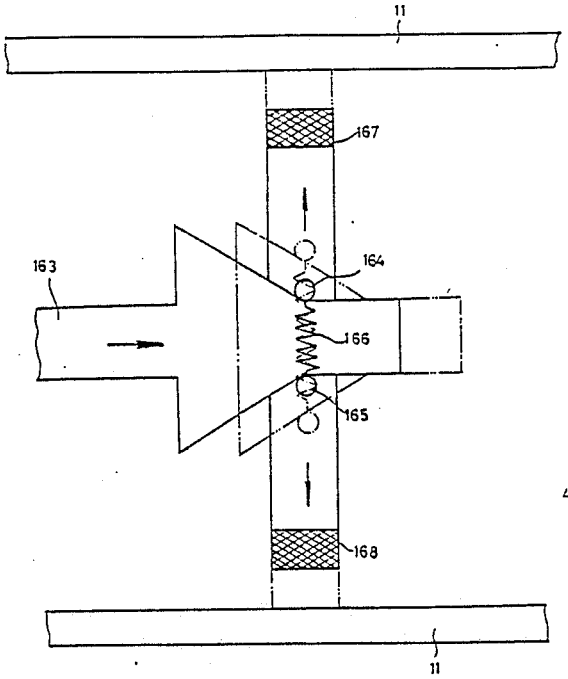
FIG. 4 illustrates the brake system used in the present invention.
Figure 11B:
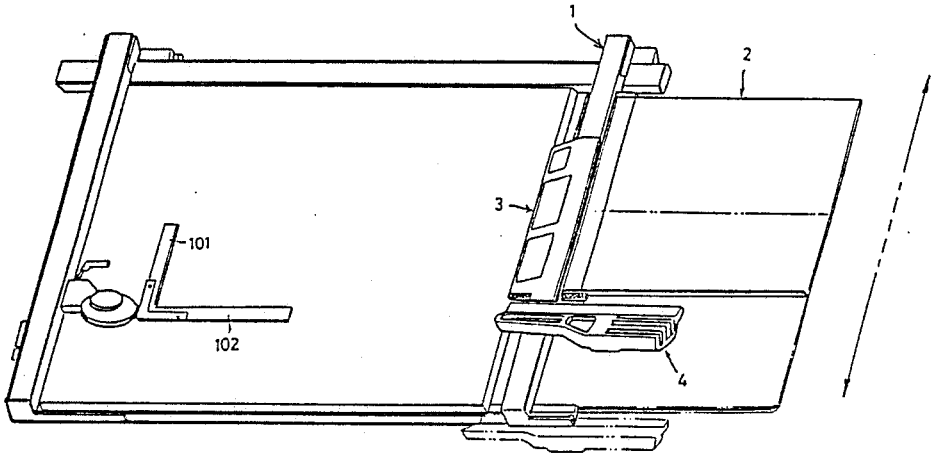
FIG. 11*b* illustrates the peripheral apparatuses of the present invention, being moved vertically.

As shown in FIG. 2, rail 1 includes an upper longitudinal wall 11. Within the internal rail space below wall 11 of the sliding rail, there are two grooves 111 and 112, in which the four rollers 12, 13, 14 and 15 in the base 19 are slidably mounted so as to have a draft panel 2, a storage tray 3 and an auxiliary instrument tray 4 connected together with the base 19 moved up and down freely with the sliding rail, as shown in FIG. 11*b*. As best shown in FIG. 2*a*, base 19 and tray 3 are arranged, respectively, below and above rail 1 so that the rail runs through the base-tray assembly; the transverse front and rear edges of the base and tray are notched to form slots for accommodating rail 1. Leftmost sections of the base and tray are located laterally to the left of rail 1; screws are extended through these leftmost sections to attach the base and tray together. In the base 19, there is a brake system 16 for positioning the draft panel 2 on a fixed position along the sliding rail 1. When the braking button 161 is pushed down, the connecting rod 162 and the braking rod 163 will be driven to move in a direction indicated with an arrow as shown in FIG. 4 to cause conic piece on the braking rod 163 to drive the brake linings 167 and 168 which are mounted with spring 166 and pins 164 and 165 to move laterally until tightly touching the inner surface of the top lid 11 of the sliding rail.

Figure 2B:
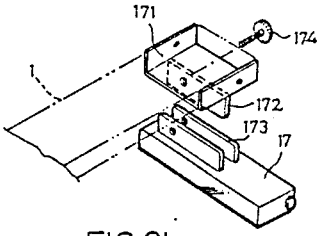
FIG. 2*b* illustrates the assembled structure between the upper end of the sliding rail and the paralleled guide of the rail according to the present invention.

FIG. 2*b* illustrates how the upper end of the sliding rail 1 is assembled together with the parallel guide 17 of the upper rail. The bottom of the front end of the sliding rail is fixedly mounted with a U-shaped member 171, under which a lug 172 is furnished, and the lug 172 is mounted between two parallel lugs 173 by means of a screw 174.

Figure 2D:
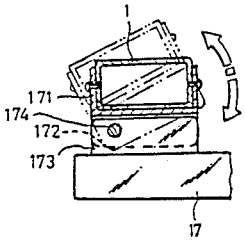
FIG. 2*d* is a sectional view, showing the assembled structure between the sliding rail and the paralleled guide of upper rail, and also showing the sliding rail being set at a given angle.
Figure 2C:
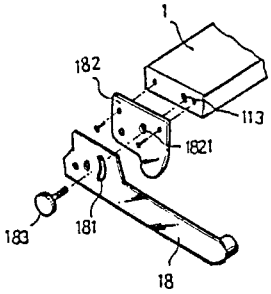
FIG. 2*c* illustrates the assembled structure between the lower end of the sliding rail and the auxiliary roller frame according to the present invention.

FIG. 2*c* illustrates how the lower end of the sliding rail 1 is assembled together with an auxiliary roller frame 18. Between the lower end of the sliding rail 1 and the auxiliary roller frame 18, there is a fixing plate 182 being fixedly attached to the bottom end of the sliding rail. The anxiliary roller frame 18 has a curved hole 181 to receive an adjusting screw 183. The screw 183 also passes through a screw hole 1821 on the fixing plate 182 so as to fix the fixing plate 182 to the sliding rail by means of a screw hole 113.

FIG. 2*d* illustrates the sliding rail 1 being set at a given slanting angle; naturally, the bottom end of the sliding rail will also be set at the same slanting angle.

Figure 2E:
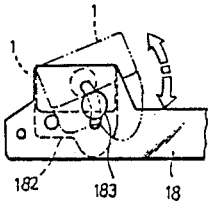
FIG. 2*e* is side view, showing the assembled structure between the sliding rail and the auxiliary roller frame, and also showing the sliding rail being set at a given angle.

FIG. 2*e* illustrates the sliding rail 1 being fixed at a position with the adjusting screw 183 after being set at a given angle desired so as to facilitate the drafting operation of the draftsman, such as to obtain a better visual position.

Referring to FIGS. 1 and 3, there is shown the draft panel 2 for supporting drafting paper 201, while the storage tray 3 is used to support a vernier caliper 301, a calculator 302, a chit book 303 and a pencil sharpener 304; in the auxiliary instrument tray 4, there are a pencil 401, a rubber eraser 402, a technical drawing pen 403, a compass 404, a brush 405, and a drawing template 406 for draftsman operation convenience.

Figure 6A:
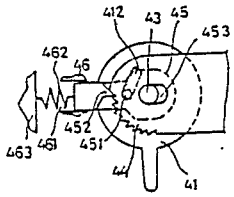
FIG. 6*a* illustrates the positioning structure of the auxiliary instrument tray according to the present invention.
Figure 6B:
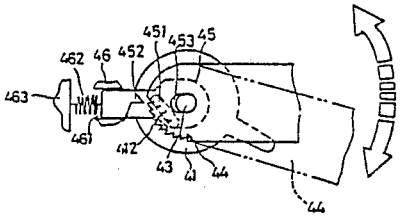
FIG. 6*b* illustrates the positioning structure shown in FIG. 6*a* being moved to a given position.
Figure 7A:
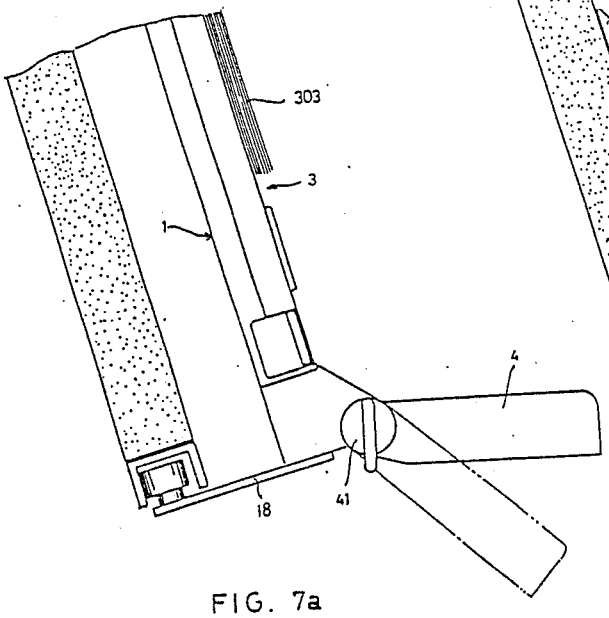
FIG. 7*a* illustrates the auxiliary instrument tray, being operated.
Figure 8B:
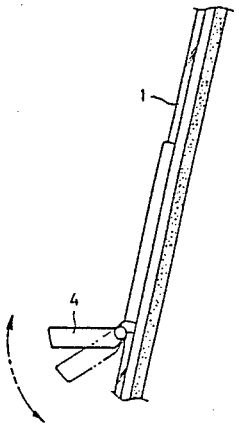
FIG. 8*b* illustrates the auxiliary instrument tray able to be set at any angle.
Figure 9C:
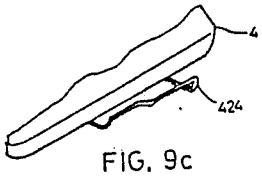
FIG. 9*c* illustrates a fragmental view of the brush rest on the front edge of the auxiliary instrument tray according to the present invention.
Figure 9B:
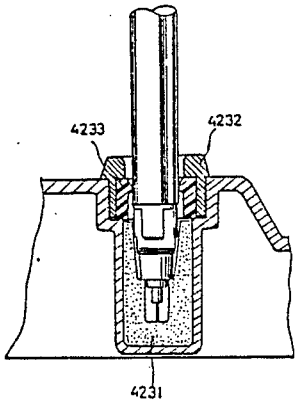
FIG. 9*b* is a sectional view of the socket of the technical drawing pen.
Figure 9A:
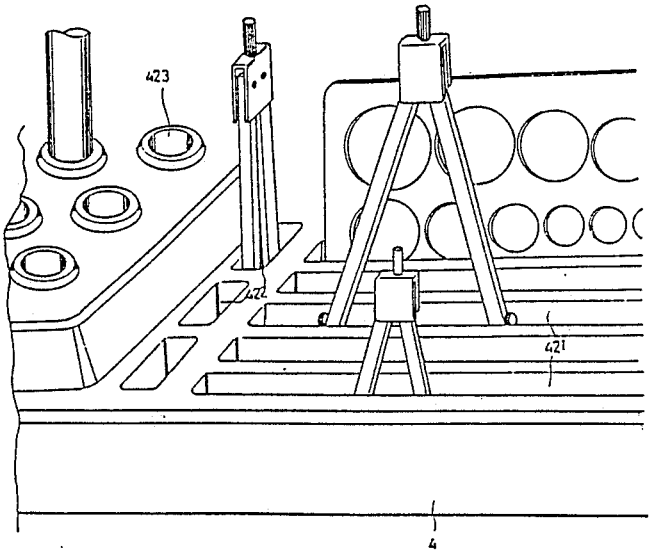
FIG. 9*a* illustrates a fragmental structure of the auxiliary instrument tray with some auxiliary instruments being put in the tray.

FIGS. 7*a*, 8*a* and 8*b* illustrate the auxiliary instrument tray 4, which can be adjusted at any angle by means of an adjusting knob 41 so as to fit the level of drafting board set as shown in FIG. 8*a* for placing various auxiliary instruments. The auxiliary instrument tray 4 can provide several functions as shown in FIG. 9, in which the long groove 421 is used for placing drawing templates 406 (such as ring gauge and ellipsograph, etc.) or compass 404 opened. The short slots 422 are used for placing compass 404 not being opened. Particularly, the drawing pen socket 423 as shown in FIG. 9*b* is mounted on the bottom thereof with a rigid sponge 4231; the socket 423 is furnished with a top lid 4232, under which a rubber ring 4233 is fitted for holding the drawing pen tightly in place. Before inserting the drawing pen into the socket, a several drops of water are dripped on the rigid sponge 4231 so as to prevent the drawing pen from becoming dried before use. FIG. 9*c* illustrates the bended structure of the brush rest 424 for placing a brush 405. The adjustment structure of the auxiliary instrument tray is further illustrated in FIGS. 5*a*, 5*b*, 6*a* and 6*b*. The flat end 431 of the rotary shaft 43 is mounted in the rectaugular recess 411 of the adjusting knob; there is a catch block 45 being mounted between two washers 432 and 433. A ratchet wheel 44 is mounted on the rotary shaft 43, which is drectly connected with the auxiliary instrument tray 4 integrally molded with the ratchet wheel 44. The catch block 45 has a pin 451, which extends into a slot 412 on the adjusting knob 41. The ratchet wheel 44 is engaged with a pointed pawl 452, which is to be inserted into a chennel 461 of a block 46 that is attached to the base 19. The back side of the pointed pawl 452 is loaded with a spring 462. The pointed pawl 452 is detained in a movable manner in the channel 461 by means of a cover plate 464 and screws.

Figure 5B:
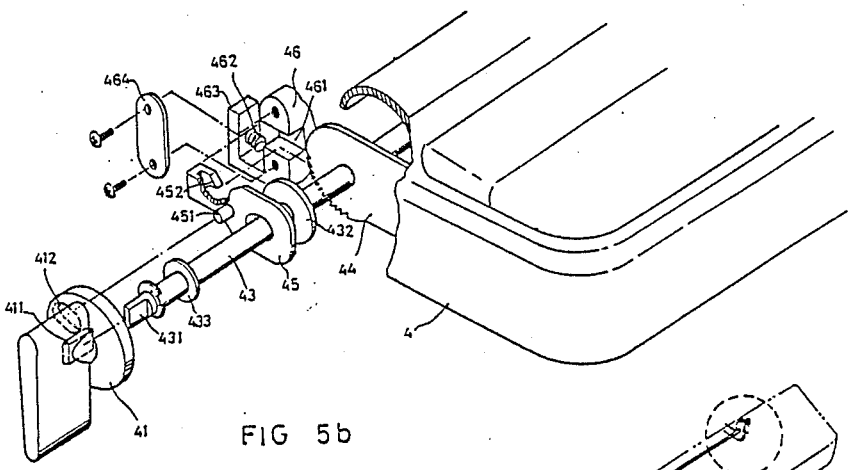
FIG. 5*b* is a disassembled view of the connecting part of the auxiliary instrument tray according to the present invention.
Figure 5A:
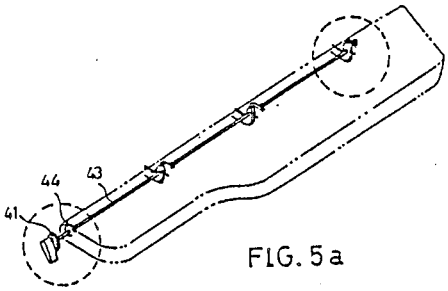
FIG. 5*a* illustrates the assembled structure of the auxiliary instrument tray according to the present invention.

FIG. 6*a* illustrates the pointed pawl 452 being engaged with the ratchet wheel 44 so as to have the auxiliary instrument tray 4 set at a position desired; in this case, the spring 462 is set at a natural length condition. When the adjusting knob is turned counter-clockwise as shown in FIG. 6*b*, the pin 451 on the catch block 45 will be driven along the slot 412 to cause the catch block 45 to move leftwards so as to have the pointed pawl 452 disengaged from the ratchet wheel 44; in that case, the auxiliary instrument tray 4 can be turned freely to a suitable position desired; then, the adjusting knob 41 is turned to a position as shown in FIG. 6*a* to have the pointed pawl 452 engaged with one tooth of the ratchet wheel 44, whereby the auxiliary instrument tray 4 is fixed at a given position. FIG. 5*a* illustrates that both ends of the auxiliary instrument tray are provided with the aforesaid structure as shown in FIG. 5*b*.

Figure 10B:
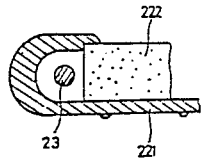
FIG. 10*b* is a sectional view taken on line X—X' in FIG. 10*a*.
Figure 10A:
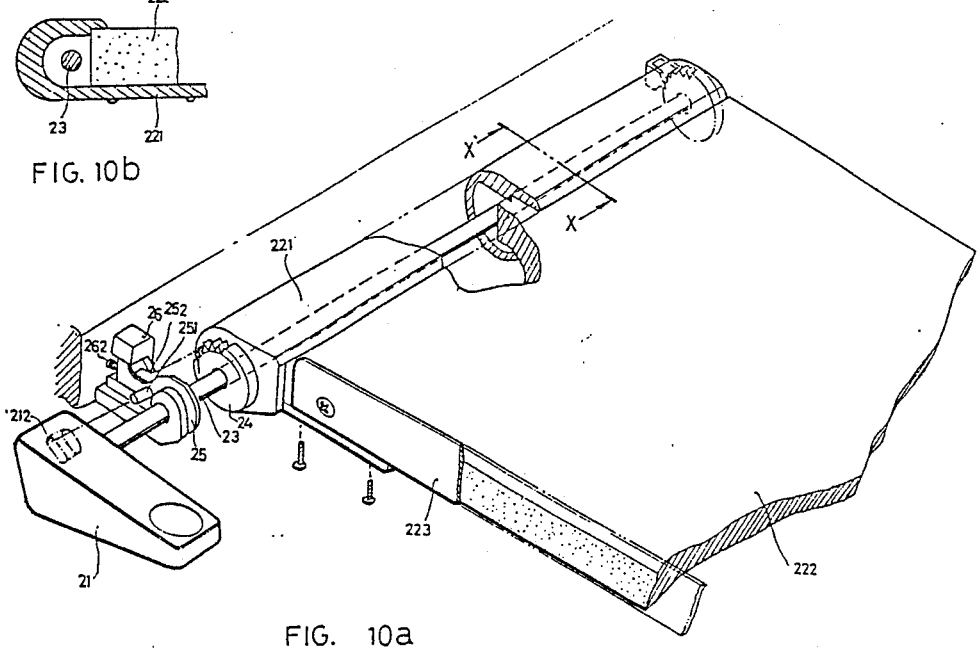
FIG. 10*a* illustrates the structure of the manuscript board of the present invention.
Figure 11C:
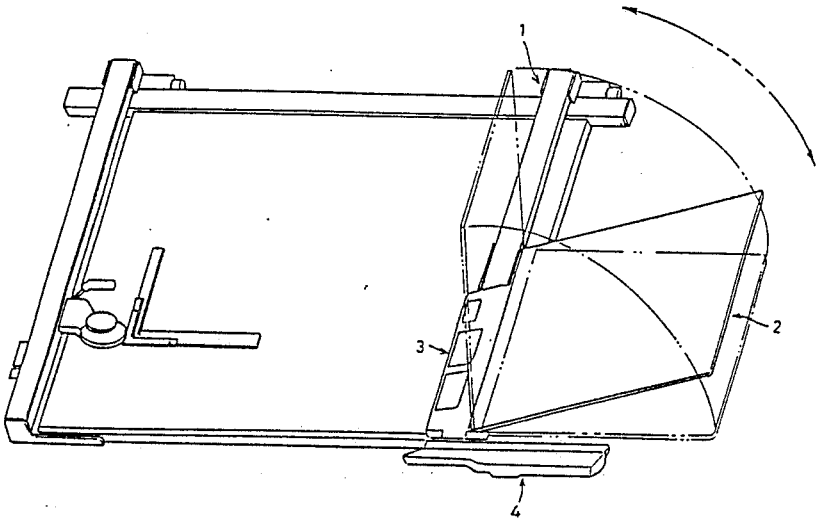
FIG. 11*c* illustrates the draft panel of the present invention, being moved at an angle.

Referring to FIG. 10*a*, there is a board 222 being attached to a support arm 27 (as shown in FIG. 2), which is attached to the base 19. The angle-adjusting knob 21 has a sliding slot 212 for receiving the pin 251 of a catch member 25. A shaft 23 is used to couple the ratchet wheel 24 and the catch member 25 together. The pawl 252 of the catch member 25 is mounted inside a recess of the block 26, and is loaded with a spring 262 on the back of the pawl 252. By means of the aforesaid structure, the draft panel 2 can be turned and positioned around the shaft 23 as shown in FIG. 11*c*. The draft panel 2 consists of a board 222 and a guard plate 223 being attached with screws, to the board 222 edge. One side of the connecting plate 221 is hooked around the shaft 23, while the flat side thereof is connected together with the board 222 by means of screws. The upper end of the connecting plate 221 has corner pant, in which the board 222 is inserted.

Figure 12A:
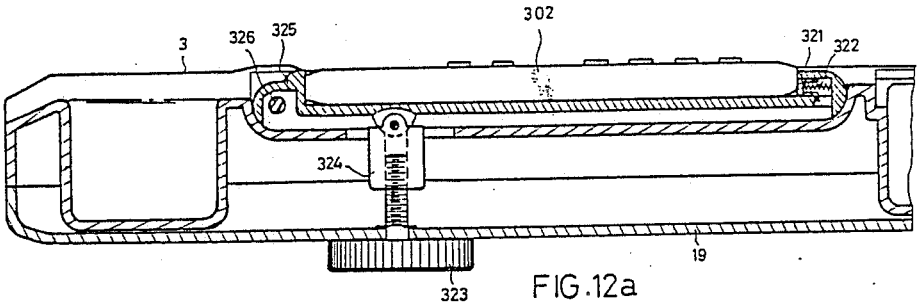
FIG. 12*a* is a longitudinal sectional view, showing the calculator being put in a storage tray.
Figure 12B:
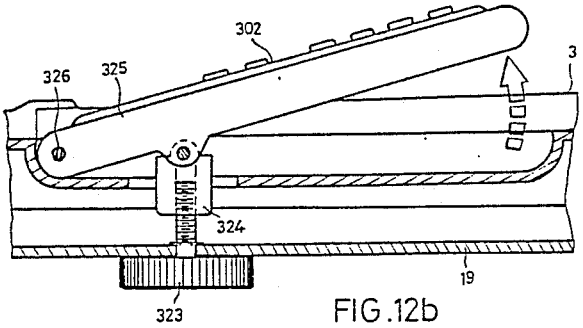
FIG. 12*b* illustrates the calculator able to be adjusted at a high or low position desired.
Figure 12D:
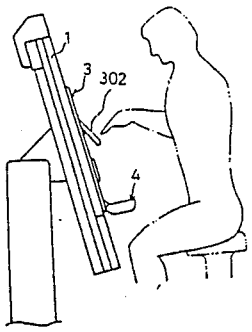
FIG. 12*d* illustrates the calculator being operated by a draftsman.
Figure 12C:
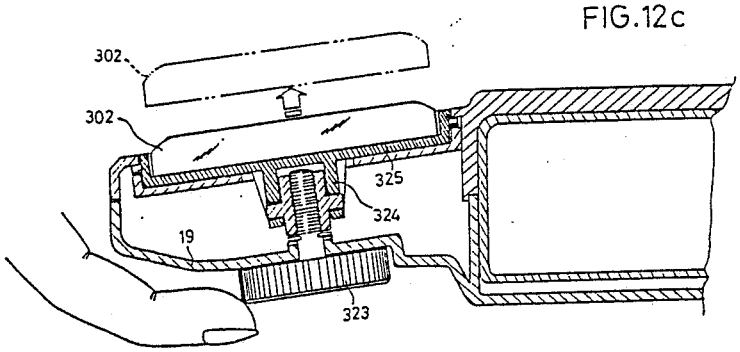
FIG. 12*c* is horizontal sectional view, showing the calculator, being put in the storage tray.

On the storage tray 3 as shown in FIG. 2*a*, the upper end of the vernier caliper rest 31 is mounted with a magnetic rubber 311 for fixing the vernier caliper in place without dropping. A pencil sharpener rest 34 is furnished on the storage tray for holding a pencil sharpener 304 therein. FIGS. 12*a* and 12*b* illustrate the calculator rest 32, in which a fastening block 321 loaded with a spring 322 is used for holding the calculator in place. One end of the base plate 325 is pivotally attached in place with a pin 326, while the bottom of the base plate 325 is mounted with a push block 324 and a lock screw 323 through the base 19. The lock screw 323 is mounted in place in an adjustable manner so as to drive the push block 324 and the base plate 325 up or down to meet the human engineering requirement during making drawings as shown in FIGS. 12*c* and 12*d*. The storage tray 3 is fastened to the base 19 with screws. Further, the storage tray has a sloping surface to enable the draftsman to see instruments, such as the calculator or the chit book, at a comfortable angle.

Figure 13A:
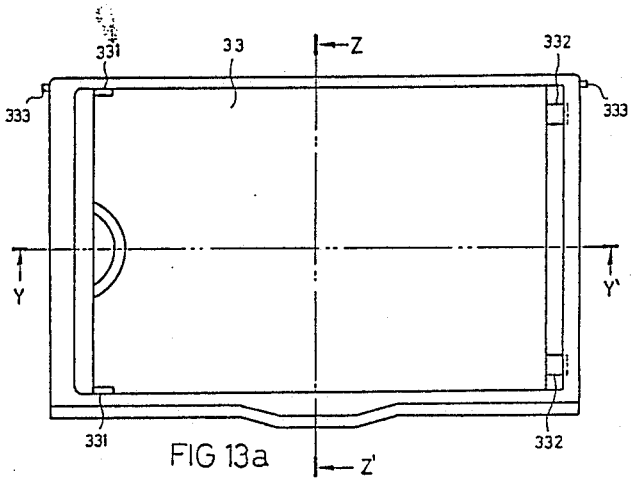
FIG. 13*a* is a top view of the note board according to the present invention.
Figure 13B:
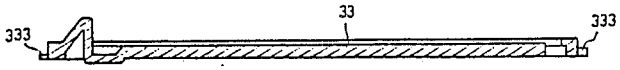
FIG. 13*b* is a sectional view of the note board taken on line Y—Y' in FIG. 13*a*.
Figure 13C:
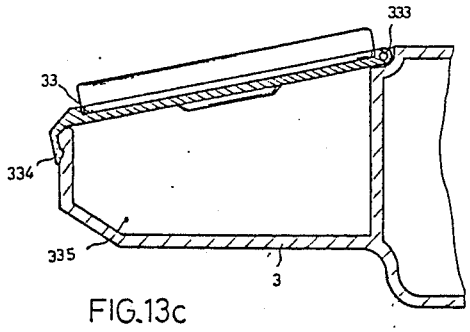
FIG. 13*c* is a sectional view of a storage channel on the storage tray taken on line Z—Z' in FIG. 13*a*.

The storage tray 3 is also furnished with a note board 33 as shown in FIGS. 13*a* and 13*b*; on the note board 33, a chit book 303 is mounted thereon, i.e., the cardboard bottom of the chit book may be mounted on the note board 33 by inserting the front lugs 3031 and the rear lugs 3032 (shown in FIG. 3) of the cardboard bottom into the mounting holes 331 and 332 respectively. One side of the note board 33 has a projected shaft 333 on both ends of the board 33 to be inserted into the storage channel 335 so as to let the note board 33 become a rotative member as shown in FIG. 13*c*; further, the note board 33 has a hook 334, whereby the note board can be fastened to the front edge of the storage channel 335. When the note board 33 is opened the space in the storage channel can be used as a storage chamber.

Figure 14:
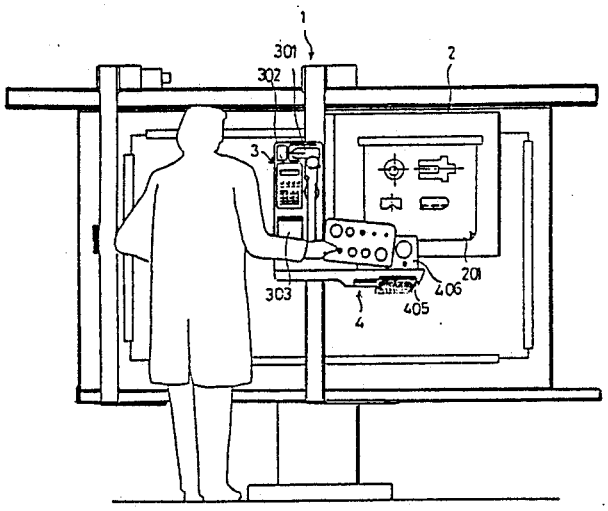
FIG. 14 is a front view of the present invention, being operated by a draftsman.

According to the aforesaid description, it is apparent that the present invention has become an integrated system as shown in FIG. 14 to provide the draftsman with a convenient and practical drafting table with a plurality of peripheral apparatuses; for instance, the positioning devices for the draft panel and the calculator have been well designed to comply with the requirements of human engineering. It is deemed that the present invention is the best drafting table so far.

What is claimed is:

1. In combination with a tiltable drafting table having an upwardly-facing drafting surface, a front edge, a rear edge, and two side edges: the improvement comprising an elongated rail (1) oriented an appreciable distance above the drafting surface parallel to the table side edges; said rail having a rear end spaced above the table rear edge, and a front end spaced above the table front edge;

a slide structure (17) carried the rear end of the rail for traversing movements along the table rear edge; a roller frame means (18) carried at the front end of the rail for traversing movements along the table front edge, such that the rail is movable over the drafting surface in a direction parallel to the table front and rear edges;

a base (19) slidably positioned on said rail for movement therealong; said base having a front edge, a rear edge, and two side edges;

a manually-operable brake means (16) carried on said base for frictional contact with the rail to adjustable lock the base in selected positions along the length of the rail;

an upwardly-facing storage tray (3) supported on said base between its front and rear edges;

and an instrument tray (4) extending forwardly from said base; said instrument tray having arear edge thereof swingably connected to the front edge of the base for adjusting movements of the instrument tray around a horizontal swing axis paralleling the base fron edge, such that the instrument tray can assume a horizontal position when the drafting table surface is inclined in a front-to-rear direction.

2. The combination of claim 1, wherein said elongated rail has two internal grooves (111 and 112) extending therealong; said base having a plural number of rollers supported thereon for rolling movements in said grooves, whereby said base is movable along the rail.

3. The combination of claim 1, wherein said base and storage tray are in direct vertical alignment; said base and storage tray having aligned sections thereof extending, respectively, below and above the rail, whereby the rail extends through the basestorage tray assembly; said storage tray having upwardly-facing recesses therein overlying the rail.

4. The combination of claim 1, wherein said rail has two internal longitudinal grooves (111 and 112) extending therealong; said base having a first section thereof located underneath the rail in spaced relation to the drafting surface, and a second section thereof located laterally beyond the rail; a number of rollers supported on said first section of the base for rolling movements in said grooves; said storage tray (3) overlying both sections of the base so that the rail extends through the base-storage tray assembly.

5. The combination of claim 1, and further comprising an auxiliary drafting panel (2) connected to one side edge of said base; said panel having a front edge, a rear edge, and two side edges; one of the panel side edges being swingably attached to said one side edge of the base for swinging adjustment of the panel relative to the base.

6. The combination of claim 5, and further comprising manual means for locking the drafting panel in selected positions of swingable adjustment.

* * * * *